US008635722B2

(12) United States Patent
Moon et al.

(10) Patent No.: US 8,635,722 B2
(45) Date of Patent: Jan. 28, 2014

(54) MODULAR MOLDED SLEIGH BED

(75) Inventors: Brian Moon, Sycamore, IL (US); Jed C. Richardson, Batavia, IL (US)

(73) Assignee: Norix Group, Inc, West Chicago, IL (US)

( * ) Notice: Subject to any disclaimer, the term of this patent is extended or adjusted under 35 U.S.C. 154(b) by 294 days.

(21) Appl. No.: 12/795,655

(22) Filed: Jun. 7, 2010

(65) Prior Publication Data

US 2011/0296610 A1 Dec. 8, 2011

(51) Int. Cl.
*A47C 19/02* (2006.01)

(52) U.S. Cl.
USPC ..... 5/282.1; 5/308; 5/606; 5/600; 108/24

(58) Field of Classification Search
USPC ..... 5/600, 606, 282.1, 308; 108/24
See application file for complete search history.

(56) References Cited

U.S. PATENT DOCUMENTS

| | | | | | |
|---|---|---|---|---|---|
| 283,515 | A | * | 8/1883 | Rodgers | 5/604 |
| 321,983 | A | * | 7/1885 | Koss | 5/695 |
| 504,443 | A | * | 9/1893 | Staab | 5/604 |
| 666,458 | A | * | 1/1901 | Batic | 5/695 |
| 899,361 | A | * | 9/1908 | Wassam | 5/499 |
| 932,024 | A | * | 8/1909 | Barabas | 5/716 |
| 1,690,451 | A | * | 11/1928 | Leonard | 5/606 |
| 2,022,714 | A | * | 12/1935 | Gallup | 5/620 |
| 2,041,087 | A | * | 5/1936 | Ocasek | 5/606 |
| 2,165,385 | A | * | 7/1939 | Kane | 5/604 |
| 3,093,836 | A | * | 6/1963 | Christensen et al. | 5/600 |
| 4,045,011 | A | * | 8/1977 | Ford | 5/646 |
| D247,307 | S | * | 2/1978 | Johansson | D24/183 |
| 4,120,062 | A | * | 10/1978 | Anderson | 5/666 |
| 4,620,333 | A | * | 11/1986 | Ritter | 5/695 |
| 4,819,925 | A | * | 4/1989 | Linnemann et al. | 5/606 |
| 4,982,462 | A | * | 1/1991 | Wada | 4/546 |
| 5,303,438 | A | * | 4/1994 | Walker | 5/652 |
| D355,988 | S | | 3/1995 | Brooking | |
| 5,490,292 | A | | 2/1996 | Auburn | |
| 5,675,854 | A | * | 10/1997 | Zibelin | 5/695 |
| 5,704,083 | A | * | 1/1998 | Nerg | 5/600 |
| D396,566 | S | | 8/1998 | Albrecht | |
| 5,839,135 | A | * | 11/1998 | Kitamura | 5/606 |
| 6,279,510 | B1 | * | 8/2001 | Batterton | 119/753 |
| 6,282,735 | B1 | * | 9/2001 | Stolpmann et al. | 5/606 |
| 7,073,464 | B2 | * | 7/2006 | Keil | 119/753 |
| 7,140,054 | B2 | * | 11/2006 | Charles | 5/606 |
| 8,104,152 | B2 | * | 1/2012 | Spiers | 27/19 |

* cited by examiner

*Primary Examiner* — Robert G Santos
*Assistant Examiner* — Ifeolu Adeboyejo
(74) *Attorney, Agent, or Firm* — James Palmatier

(57) ABSTRACT

The invention is directed to a molded bed having a contoured sleeping surface surrounded by a liquid barrier. The sleeping surface having a plurality of channels formed therein terminating at a plurality of drains extending through the bed to direct loose liquid on the sleeping surface through a drain. The bed further comprising a means for attaching the bed to a floor and a tamper resistance glide assembly inserted in a foot on the bed, the glide comprising a floor engaging pad having a support shaft extending there from, a traveler on the support shaft. The traveler fixed in a glide pocket in the foot. The pad traversing axially in the glide pocket to orient the sleeping surface.

20 Claims, 6 Drawing Sheets

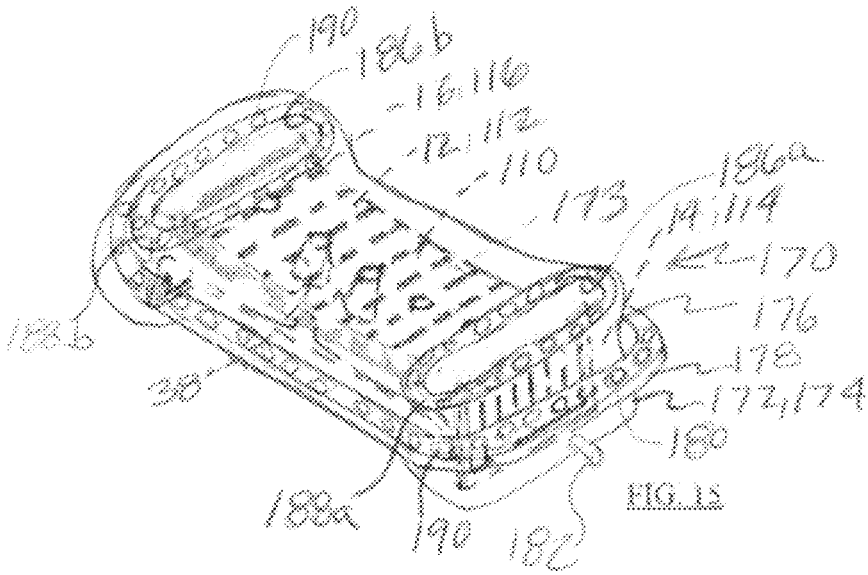
FIG. 15
FIG. 16
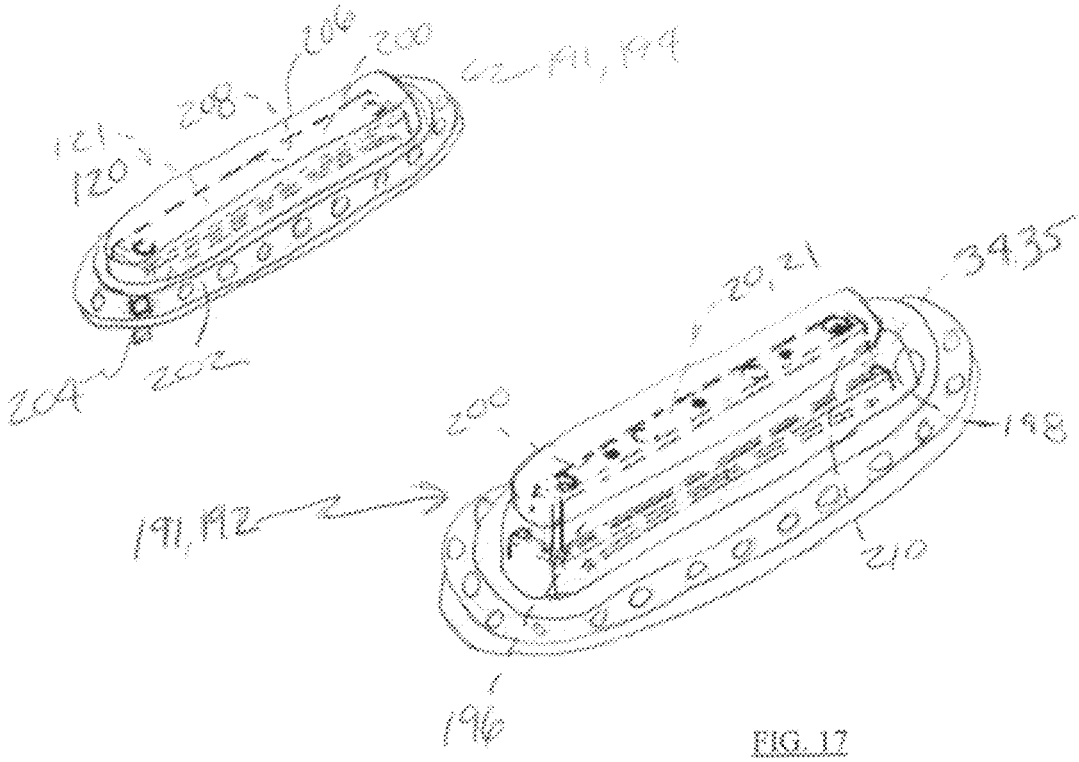
FIG. 17

MODULAR MOLDED SLEIGH BED

FIELD OF THE INVENTION

The present invention relates generally to beds used in intensive use facilities and institutional settings such as military housing, prisons, jails, detention centers and psychiatric facilities. More particularly, the present invention comprises an intensive use bed which may have a contoured sleeping surface having fluid directing drains and channels to capture and remove liquids from the bed top. The bed may be molded in a flexible mold configuration.

BACKGROUND OF THE INVENTION

Intensive use beds may be designed for use in demanding environments. Facilities housing individuals for rehabilitation from health or legal problems require beds for safely furnishing living quarters while being durable. Assembled furniture may present certain hazards in use in incarceration settings where furniture components and fasteners may be removed and turned into weapons. Plastic and fiberglass construction has replaced wood and metal by its ability to be formed into three-dimensional shapes without external fasteners. Fiberglass and plastic is generally more aesthetically appealing than steel or wood, and more resistant to damage. Wood furniture, for example is known to have problems with rotting, warping and bed bugs in these settings. Fluids can rot and damage wood furniture resulting in weakness and creating hard to remove odors. Likewise, fiberglass may crack and splinter if a direct force is applied and is heavy making it expensive to ship and hard to move. Manufacturing fiberglass furniture is also slow and involves custom production.

Intensive use bed furniture is usually bolted directly to the floor or walls. Securing the furniture to the floor or wall further reduces the safety concerns on both the prisoners or patients and staff resulting in a safer environment. Preferably, the fixation method minimizes tampering or removal of the fasteners.

Therefore, it is desirable to provide a securely attached, intensive use bed for such facilities having fluid capture and removal facilities, optional, additional load-bearing capacity and modular mold for forming a variety of configurations.

BRIEF SUMMARY OF THE INVENTION

One embodiment of the present invention is directed to an intensive use bed for use in demanding environments, comprising a rotationally molded (referred to hereinafter as (roto-molded), one piece body with a sleeping surface, a bottom surface, a plurality of drains, tamper resistant adjustable glides and a means for fastening the bed to a floor. The drains may further be part of a means for removing loose fluids from the sleeping surface comprising drain passageways through structural supports integrally molded into the bed body and external channels formed on the sleeping surface. The channels formed in the sleeping surface may urge fluids to flow by the force of gravity to integrally formed drains extending through the bed body. Fluids on the bed include loose liquids such as urine, water or other substances. Fluids flow through the drain to an airspace below the bottom surface.

The intensive use bed is supported by feet extending downward from the body to engage the floor. On or more of the feet may have a tamper resistant adjustable, glide mounted therein to level the bed and accommodate floor irregularities. An optional bariatric support may be mounted extending downward from the bottom surface.

The bariatric support may mount in one or more of the drains or by removing material from the bottom surface and inserting a head end of the bariatric support therein. The head end of the bariatric support may be affixed by adhesive or welding or the like in the selected location for supporting the bed body intermediate the head board and the foot board.

The drains may each have a drain body preformed and inserted into the mold prior to molding the bed or formed by fixtures in the bed mold. The drain body may further provide structural support between the top and bottom of the bed body. The drain body may be adapted in the bed to form a columnar support in the bed body between the sleeping surface and the bottom. The sleeping surface may further have a contoured surface to complement the force of gravity to urge fluids on the sleeping surface to flow to the drain.

The headboard and foot board may each have a foot for engaging the floor or support surface. Each foot may be spaced from the body by a leg or formed directly on the bed body. Each foot may be adapted to receive and retain a tamper resistant glide for leveling and supporting the bed. The tamper resistant glide is adapted to secure its vertically adjusting mechanism within the foot to prevent removal or tampering. The bed is attached to the wall or floor by an attachment means minimizing exposed fasteners by use of a tongue and slot assembly at one end and fasteners to hold the bed to the floor. An optional flange may be mounted on the foot of the bed providing a tongue extending from the foot or for directly attaching to the floor. A flange anchor provides a mounting slot for difficult mounting locations such as next to a wall or in a corner of a room. The flange anchor adapted to slidably receive an extended portion of the flange to reduce the installations of fasteners when the bed is in place.

The bed may be formed by a modular mold assembly for use with a rotational molding device. The modular mold may have preconfigured features adapted to be integrally molded onto the bed. The modular tooling may further have a modular configuration wherein the mold may be configured with and without certain molded features. As described herein, the bed may be molded with or without legs extending from the bed body to the feet. The modular mold has an opening surrounded by a flange adjacent the headboard and foot board proximate to the bottom wall and an attachment means such as bolt holes uniformly spaced around the periphery of each flange. A first modular leg mold attachment adapted to mold the desired feature is removably attached to the mold at the flange adjacent the headboard cavity and a second modular leg mold is likewise attached adjacent the foot board cavity. If the leg feature is not desired, the modular leg mold attachments may be removed and each replaced with a modular foot mold attachment to form the foot directly on the foot board and headboard respectively.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE SEVERAL VIEWS OF THE DRAWING

FIG. 15 is a perspective view of the modular mold having modular leg portions removed.

FIG. 16 is a perspective view of the modular leg mold portion configured to make the first embodiment of FIG. 1.

FIG. 17 is a perspective view of the modular mold leg portion configured to make the second embodiment of FIG. 9.

DETAILED DESCRIPTION OF THE INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
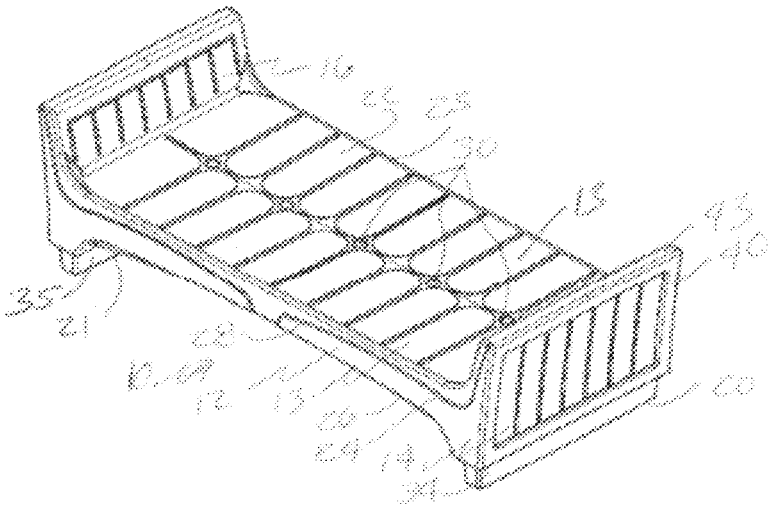
FIG. 1 is a perspective view of a first embodiment

Referring to FIG. 1, the present invention comprises an intensive use bed, generally indicated by reference number 10. The bed 10 comprises a generally rectangular box shape body 12 having a top wall 13, an integrally molded headboard 14 on a head end and integrally molded foot board 16 on a foot end. Body 12 may have a generally rectangular, hollow configuration. Body 12 may be molded from plastic by a rotational molding type process having modular mold features attachable to a bed mold portion. Alternatively, the bed 10 may be formed from fiberglass, metal or other materials. Headboard 14 may have a first leg portion 34 extending downward from the bottom wall 26 of the body 12. Likewise, foot board 16 may have a second leg portion 35 extending downward from the bottom wall 26 of the body 12.

Continuing to refer to FIG. 1, bed 10 is supported by a first foot 20 on a first leg portion 34 attached to headboard 14 and second foot 21 second leg portion 35 on foot board 16. bed 10 may further comprise side walls 24 and end walls 26. Top wall 13 may further comprise a recessed sleeping surface 22 having an upward extending liquid barrier 23 surrounding the sleeping surface 22. Side walls 24 have a surface contour pattern molded therein comprising a plurality of decorative lines 28. Bed 10 may further comprise a plurality of substantially similar drains 30 positioned in spaced relation and formed through the bed body 12.

Figure 2:
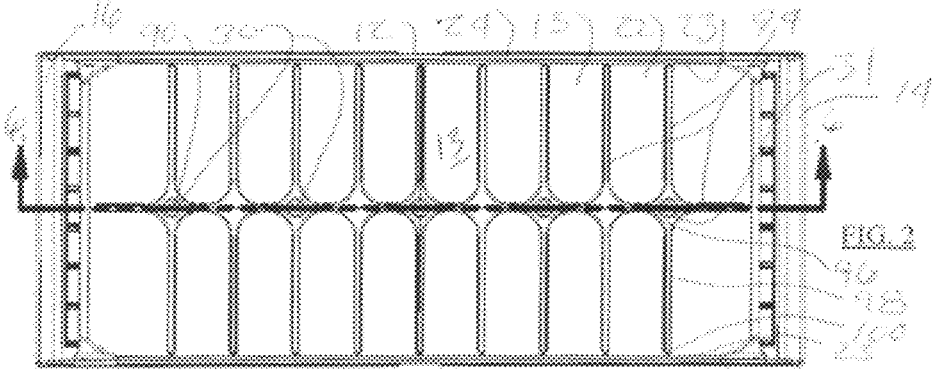
FIG. 2 is a top plan view of the first embodiment.

Referring to FIG. 2, the plurality of drains 30 may comprise a fluid path extending vertically through the body 12. Drains 30 are substantially similar to one another and shall be described referring to one of the substantially similar drains 30. Each drain 30 may comprise a separate drain body, each having a top end 31 attached to sleeping surface 22. The drain 30 is in fluid communication with a drain entrance 90 formed in sleeping surface 22. Entrance 90 is in fluid communication with an air space adjacent sleeping surface 22. Sleeping surface 22 further comprises a plurality of channels 94. Each channel 94 has a first end 96 in fluid communication with entrance 90, a recessed groove 98 and a second end 100 between drain entrance 90 and liquid barrier 23. Channel 94 formed on sleeping surface 22 may interconnect two or more drains 30.

Figure 3:
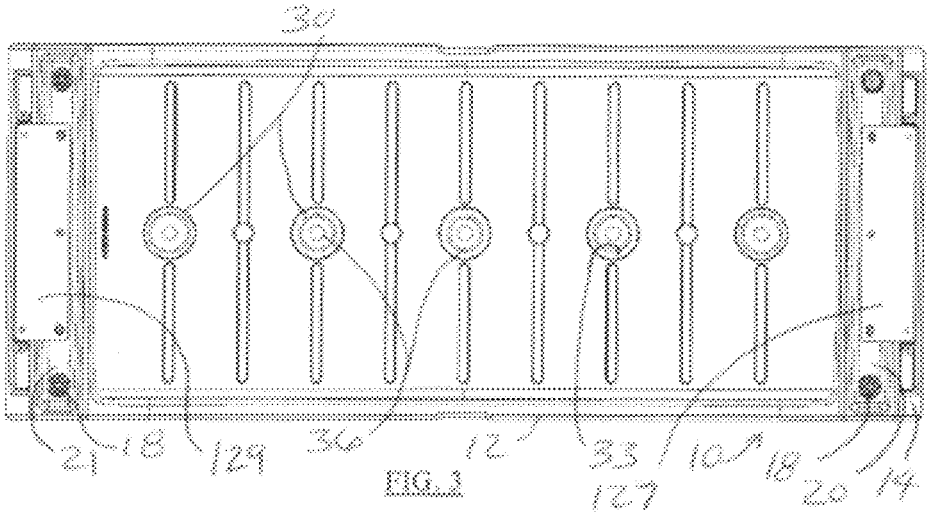
FIG. 3 is a bottom view of the first embodiment.

Referring to FIG. 3, each drain 30 may have a bottom end 33 on the bottom wall 26 and a bottom exit 36 formed by removing material from bottom wall 26. A glide pocket 55 may be integrally molded into the bottom of each foot 20, 21. A tamper resistant glide 18 may be mounted in each glide pocket 55. The glide pockets 55 may be positioned approximately adjacent the corners of bed 10.

Figure 4:
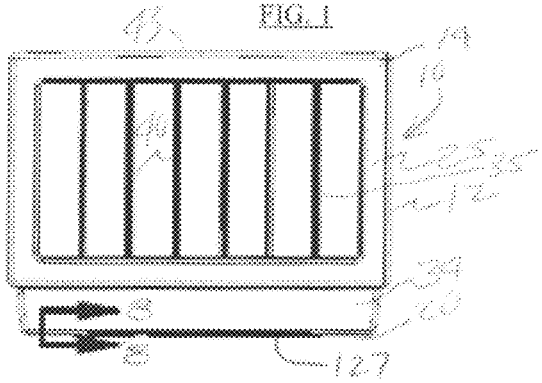
FIG. 4 is an end plan view of the first embodiment.

Referring to FIG. 4, bed 10 is supported by first leg 34 on headboard 14 and foot 20 on first leg 34. First leg 34 holds foot 20 in spaced relation to bed body 12. Glide 18 may be engaged to foot 20 to adjustably support bed 10. Bed end 25 may have integral contour lines 35 to hide surface flaws formed in molding bed 10. Head wall 40 may be configured as headboard 14 which may be molded as an integral part of bed 10. headboard 14 extends from first foot 20 to a headboard top 43.

Figure 5:
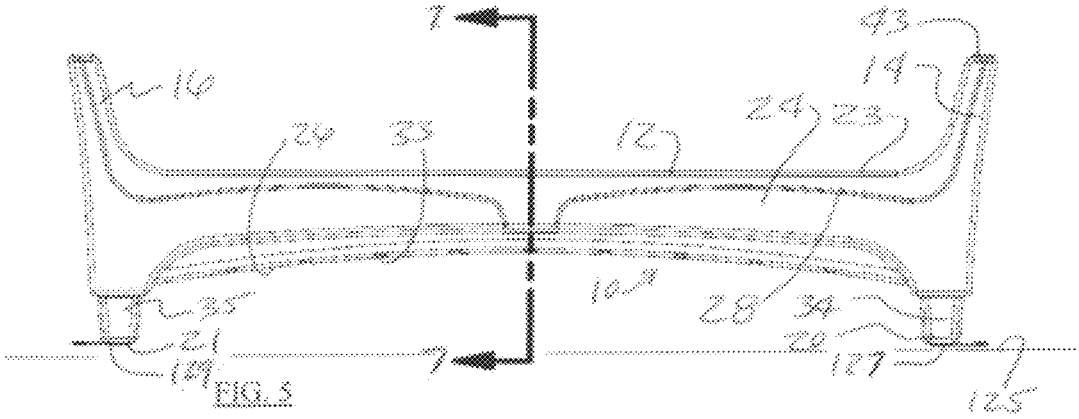
FIG. 5 is a side elevation view of the first embodiment.

Referring to FIG. 5, side walls 24 may have contour lines 28 formed therein to provide an optical illusion for hiding molding defects. Liquid barrier 23 is integrally molded into side walls 24 which are integral with headboard 14 and foot board 16. Bottom wall 26 may have a generally curved shape to help support a heavy user (not shown). First leg 34 may have first mounting flange 127 attached thereto. Second leg 35 may have second mounting flange 130. First mounting flange 127 and second mounting flange 130 may be attached to floor 125.

Figure 6:
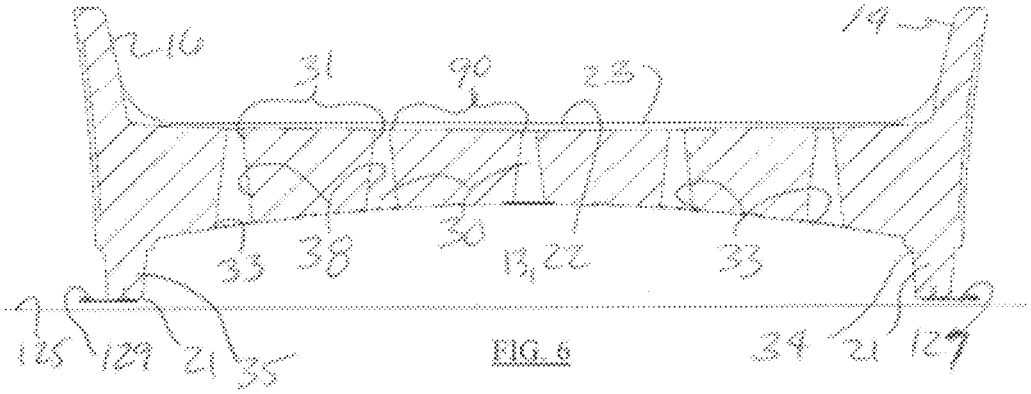
FIG. 6 is a section view of the first embodiment taken at approximately 6-6 of FIG. 2.

Referring to FIG. 6, bed 10 is formed of a molding material 31 selected for use with rotomolding operations. Channel 94 may be formed in a configuration wherein the groove 98 on sleeping surface 22 interconnects drains 30. Sleeping surface 22 may be configured having a gradually sloping surface having a higher elevation adjacent fluid barrier 23 and a lower elevation at drains 30 to urge fluid to flow toward entrance 90. Further, a sloping interior depth along channel 94 adapted to provide gravitational urging of fluid flow in channel 94 towards drains 30. The fluid path continuing through the drains 30 to an airspace below bottom wall 26. It should be understood, each drain 30 may comprise a hollow drain body 38 having a bottom drain end 33 on bottom wall and top drain end 31 on top wall 13 to support top wall 13 and bottom wall 26 in spaced relation. Each drain body 38 is generally open having a cylindrical or fruscoconical shape.

Figure 7:
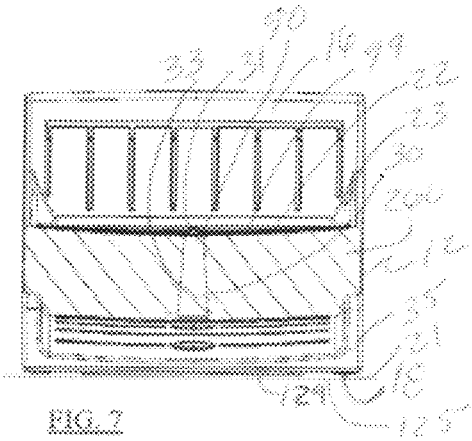
FIG. 7 is a section view of the first embodiment they can add approximately 7-7 of FIG. 5.

Referring to FIG. 7, hollow body 12 may be filled with supporting foam filler 260. Drain 30 extends from sleeping surface 22 to bottom wall 36. Second drain end 31 is attached to and in fluid communication with sleeping surface 22. Sleeping surface 22 is contoured to provide a sloping surface between liquid barrier 23 and entrance 90 to urge liquids (not shown) to flow by force of gravity into drain 30. Second leg 35 spaces second foot 21 from bed body 12. Tamper resistant glide 18 vertically adjustments to orient sleeping surface 22 with respect to a horizontal position.

Figure 8:
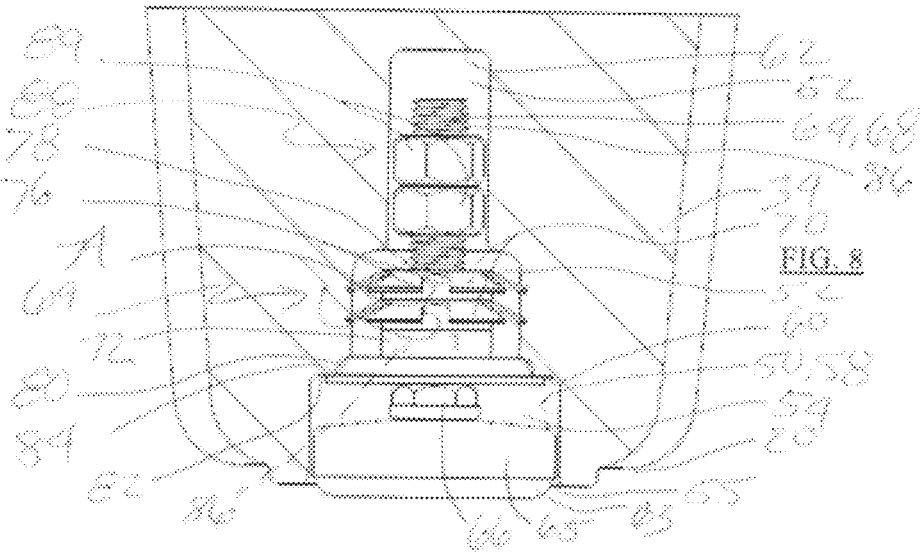
FIG. 8 is a section view of the first embodiment taken at approximately 8-8 of FIG. 4.

Referring to FIG. 8, each glide pocket 50 is adapted to receive tamper resistant glide 18. Glide pocket 50 extends from a generally cylindrical pad opening 55 in foot 20, 21 to closed end 62. Each glide pocket 50 may have an adjustment chamber 52 adjacent closed end 62 and a pad chamber 54. Pad chamber 54 comprises sidewall 58 and shoulder support 60.

Continuing to refer to FIG. 8, glide 18 comprises a pad 63 on foot 65, support shaft 64 having a first end 66 on foot 65 and a second end 68. Glide 18 further comprises an adjustment means 69 for adjusting the generally vertical position of the pad 63. Adjustment means 69 engages sidewall 58 and may be threadably engaged to support shaft 64 to allow the support shaft 64 to traverse in glide pocket 50 in a generally vertical direction. Adjustment means 69 may comprise a generally circular first and second locking washers 70 and interconnected traveler 72. Traveler 72 may have a body 73 threadably connected to support shaft 64. Traveler body 73 may have a shoulder plate 80 on first and second locking washer 70 which may be separated by spacers 77 and retained thereon by rivets, welding, adhesive or the like. The traveler body 73 may have a deformed upper end 75 to retain the shoulder plate 80, and washers 70 thereon. Each locking washer 70 may have a peripheral edge with material removed to form a plurality of exterior edges 74 comprising engaging tips 76. Each locking washer 70 may further be adapted to receive body 73 at a generally centered support shaft opening 78. The shoulder plate 80 may be adapted to engage and bear against shoulder support 60. A flange 84 on shoulder plate 80 adapted to engage chamber ceiling 82. Flange 84 may engage sidewalls 58 or chamber ceiling 82 to support glide 18. Support shaft 64 may also have external threads 86 adapted to threadably engage traveler 72 at interior threads 86 to allow traveler 72 to threadably traverse vertically between first end 66 and second end 68 upon rotation of support shaft 64. This rotational movement of the support shaft 64 is translated to an extending and retracting movement of the pad 63 in the pad opening 55. Lock 88 is attached to support shaft 64 between first locking washer 70 and second end 68. Lock 88 may be formed out of a plurality of threaded nuts 89 secured to support shaft 64. Lock 88 may be positioned adjacent to second end 68 to retain traveler 72 on support shaft 64.

Continuing to refer to FIG. 8, glide 18 is inserted into a glide pocket 50 having support shaft 64 generally vertical and coaxial with glide pocket 50. Glide pad 63 is in pad opening 55 and extends from foot 21 to engage floor 125. Locking washer 70 engages sidewall 58 to resist glide 18 removal.

Figure 9A:
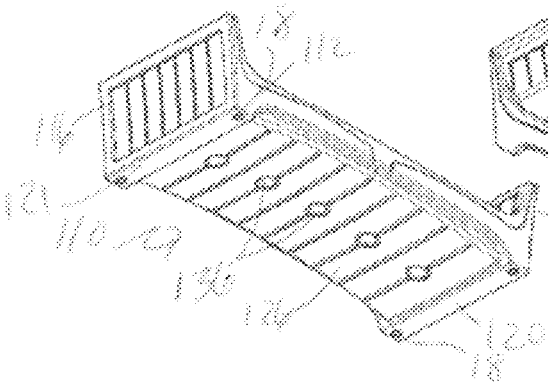
FIG. 9 is a bottom perspective view of a second embodiment.
Figure 9B:
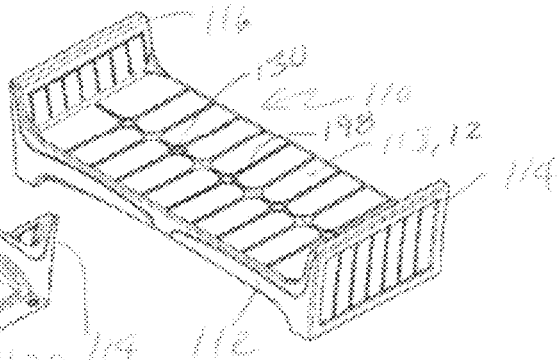

Referring to FIGS. 9*a* and 9*b* alternate embodiment short bed 110 comprises a body 112 having a headboard 114, foot board 116, top wall 113 and bottom wall 126. Headboard 114 may be integrally formed with first foot 120 adjacent bottom wall 126 and likewise second foot 121 adjacent bottom wall 126 is formed directly on foot board 116. Glides 18 may be mounted in first foot 120 and second foot 121 in glide pockets 50 to adjustably engage floor 125 (FIG. 12).

Figure 10:
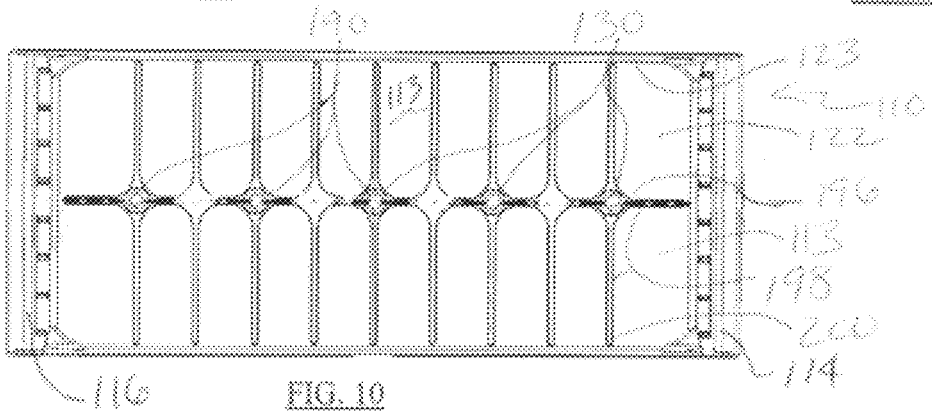
FIG. 10 is a top plan view of the second embodiment.

Referring to FIG. 10, the short bed 110 may have a top sleeping surface 122 formed on top wall 113 and surrounded by liquid barrier 123. A plurality of drains 130 are formed in body 112 having an opening 190 on sleeping surface 123. Fluid channels 198 may be formed on sleeping surface 122 having a first end 196 adjacent drain opening 190 and a second end 201 between opening 190 and liquid barrier 123.

Figure 11:
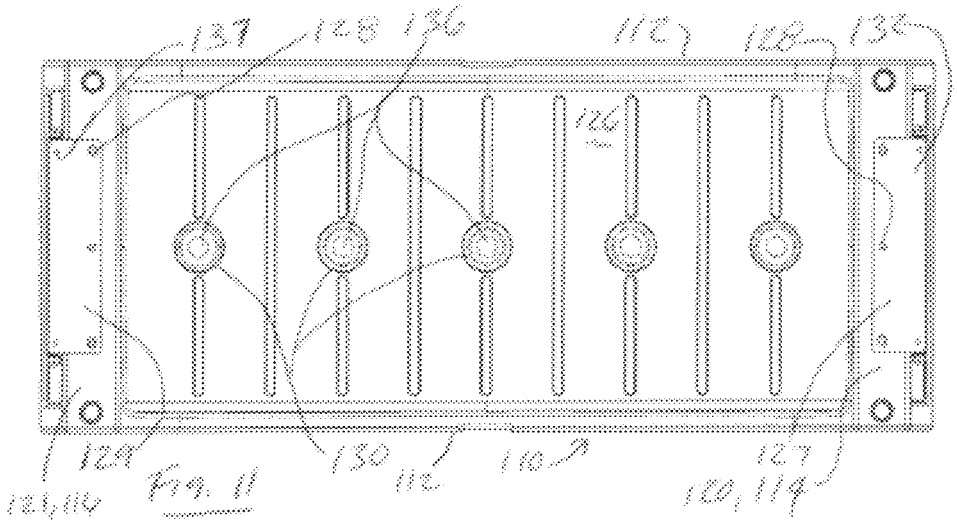
FIG. 11 is a bottom plan view of the second embodiment.

Referring to FIG. 11, body 112 may have bottom wall 126 extending between headboard 114 and foot board 116. Bottom wall 126 enclosing the generally rectangular body 112. Each drain 130 opens at a respective drain exit 36 on bottom wall 126. Glides 18 may be mounted in each corner of short bed 110 on the first foot 120 and second foot 121. First foot 120 may further have first mounting flange 127 attached adjacent to or intermediate tamper resistant glides 18. First mounting flange 127 may extend from first foot 120 with flange tongue 132. First mounting flange 127 may be mounted on first foot 120 by threaded fastener 128 or other secure method such as welding. Second mounting flange 129 is likewise mounted on second foot 121 using threaded fastener 128, adhesive or other secure mounting methods known in the art. Second mounting flange 130 may extend from second foot 121 having a plurality of bolt holes 137 for securing short bed 110.

Figure 12:
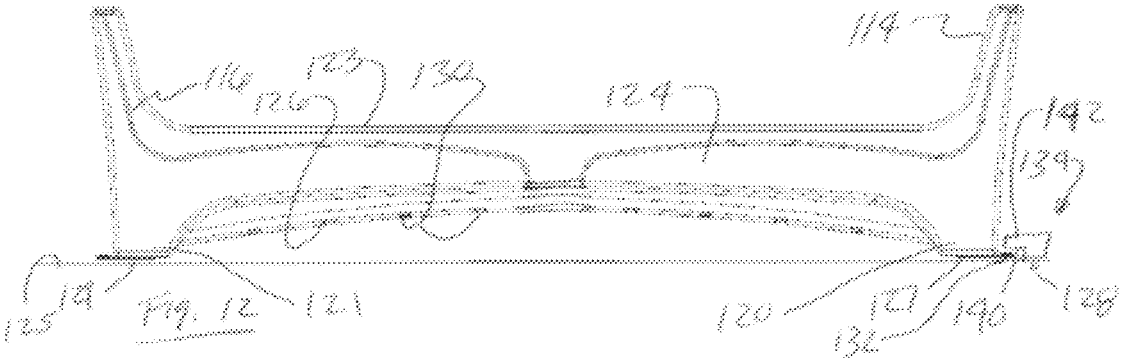
FIG. 12 is a side plan view of the second embodiment.

Referring to FIG. 12, first foot 120 is formed directly on headboard 114. First mounting flange 127 on first foot 120 may have a tongue portion 132 extending from first foot 120. Flange anchor 134 comprises a floor plate 138 having a plurality of bolt holes 136 for attachment to floor 125. Flange anchor 134 further comprises a flange pocket 140 adapted to receive tongue portion 132. Flange anchor 134 is bolted to the floor 125 using threaded fasteners 128 or the like and positioned to receive tongue portion 132 slidably in flange pocket 140. Flange anchor top 142 bears against tongue portion 132 to secure first foot 120 to floor 125. Each glide 18 may adjust the position of the pad 63 to orient the sleeping surface 122 to a generally horizontal position. Second mounting flange 129 is bolted to the floor 125 to securely hold first mounting flange 127 captive in flange anchor 134. Second mounting flange 130 secures second foot 121 from horizontal and vertical movement with respect to the floor 125

Continuing to refer to FIG. 12, the bed may be mounted in a corner of a room or next to a wall, making it difficult to secure fasteners on both the headboard 14 and foot board 16. The flange anchor 134 may be mounted adjacent the wall, having flange pocket 140 oriented for slidably receiving tongue portion 132. Tongue portion 132 is slid into flange pocket 140 securing first foot 120. Second flange 130 may then be attached to floor 125 to secure bed 10.

Figure 13:
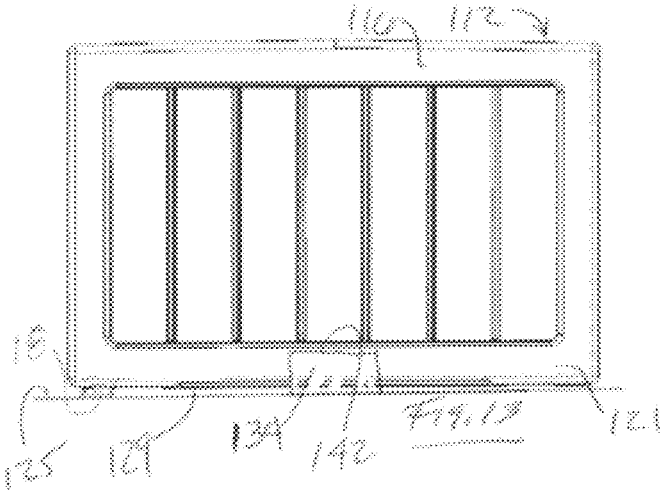
FIG. 13 is a section view of the second embodiment taken and approximately 13-13 out FIG. 12.

Referring to FIG. 13, second foot 121 may be formed directly on foot board 116 and may bear against floor 125. Drain 130 has opening 190 include communication with sleeping surface 122 and drain exit 136 in communication with an airspace space underneath bottom wall 126.

Figure 14:
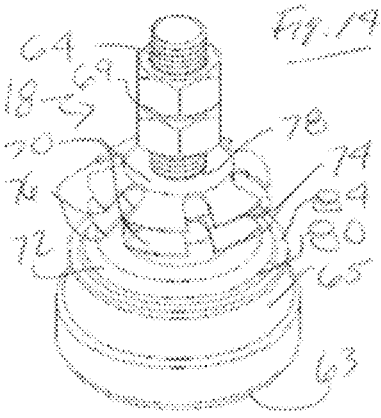
FIG. 14 is a side plan view of the tamper resistant glide.

Referring to FIG. 14, glide 18 may have a plurality of locking washers 70, each locking washer having a plurality of peripheral engagement edges 74 with material removed to form engagement point 76. The locking washers 70 may have a concave shape oriented to resist removal. Traveler 72 may be attached to the locking washers 70. Traveler 72 traverses along support shaft 64 to change the spacing between glide foot 65 and support shoulder 80 extending and retracting pad 63. As traveler 72 traverses along support shaft 64, pad 63 moves vertically with respect to locking washer 70.

Referring to FIG. 15, a modular rotary mold 170 for forming either bed 10, 110 may comprise a two-piece hollow shell 172 having a first-half 174 bolted to a second-half 176 at flange 178 and held in place by a plurality of bolts 180. Rotary mold 170 may have a rotation spindle attachment 182 for engaging a rotation fixture (not shown). Rotary mold 170 has an interior cavity 173 configured to form body 12, 112, with attached headboard 14, 114 and foot board 16, 116, respectively. A flanged first foot opening 186*a* adjacent to a bottom portion of headboard 14, 114 comprises a head flange 188*a* for attaching a modular feature mold portion 191 (FIGS. 16, 17). The head flange 188*a* may have a means for sealingly attaching a mold portion illustrated as a plurality of bolt holes 190 formed therein. Likewise, second foot opening 186*b* is formed in rotary mold 170 adjacent foot board 16, 116 and surrounded by a foot flange 188*b* having a plurality of bolt holes 190 formed therein. Means for sealingly attaching a mold portion may alternatively comprise clamps, latches or the like.

Continuing to refer to FIGS. 15, 16 and 17, modular feature mold portion 191 may be configured as a first preconfigured modular foot mold portion 194 having a molding cavity 200 for forming a foot 120, 121 attached directly to footboard 112 or headboard 114, respectively or second preconfigured modular leg mold portion 192, having a molding cavity 198 adapted for forming foot 20, 21 on leg 34, 35, integrally molded to headboard 14 or foot board 16, respectively. It should be understood, modular feature mold portions 191 are preferably used in pairs of similar configuration, having two similar mold portions 192 or 194 attached to rotary mold 170 to form a bed 10 or short bed 110. Feature mold portion 191 may be configured as a pair of modular leg mold portions 192, the first of the pair adapted to attach to first foot opening 186*a* for forming first foot 20 on first leg 34 which is molded as an extension of headboard 14 by integral molding, the second of the pair adapted to sealingly attach to second foot opening 186*b* for forming a second foot 21 on second leg 35 molded as an extension of foot board 16. Alternatively, feature mold portion 191 may be configured as a pair of modular foot mold portions 194, the first of the pair adapted to attach to first foot opening 186*a* for forming first foot 20 directly on headboard 14 by integral molding, the second of the pair adapted to sealingly attach to second foot opening 186*b* for forming a second foot 21 directly on foot board 16. First foot 20, 120 and second foot 21,121 may each have integrally molded glide pocket 54 formed therein.

Referring to FIGS. 1, 15 and 17, leg mold portion 192 may have a hollow leg forming portion 196 having a concave inner surface 210 preconfigured to form a leg portion 34, 35 attached to headboard 14 or foot board 16 holding foot 20, 21 spaced from bed body 12. Leg mold portion 192 may further comprise a tall flange 198 adapted to matingly seal to either head flange 188*a* or foot flange 188*b*. It should be understood referring to FIGS. 1 and 15, a leg mold portion 192 may be attached to modular rotary mold 172 at both head flange 188*a* and foot flange 188*b* to form an intensive use bed 10 (FIG. 1) having a first leg portion 34 on headboard 14 adapted to hold the first foot 20 in spaced relation to headboard 14.

Referring to FIGS. 9, 15 and 16, modular foot mold portion 194 may have a hollow foot forming portion 200 having a concave inner surface 208 preconfigured to form a first foot 120 directly on foot board 116. Foot mold portion 194 may likewise have a flange 202 adapted to matingly connect to either flange 188*a, b* to close the inner cavity. A foot mold portion 194 may be sealingly connected to each of the head flange 188*a* and foot flange 188*b* to form a short bed 110. Bolts 204 may extend through short flange 202 to threadably engage head flange 188. The foot mold portion 194 may further comprise an outer surface 206 surrounding the short concave inner surface 208 surface.

Referring to FIGS. 1-17, a method of manufacturing bed 10 may comprise the steps, not necessarily in the order listed of placing preformed drain body 38 in the first mold portion 174 extending perpendicular from top wall inner mold concave surface 175 to bottom wall concave surface 177. Alternatively, body 38 may be formed by a molding fixture (not shown) preconfigured between bottom wall concave surface 177 and top wall inner surface 175. The mold portions 172 and 174 with modular feature mold portions 191 attached, are bolted together to form an enclosed mold cavity 173, Continuing to refer to FIGS. 1-17, a plastic molding material 31 (FIG. 6) such as linear low-density polyethylene is heated and placed into the mold 172 for forming into bed 10. The mold 172 is rotated about one or more axes to distribute the molding material 31 about the concave surface 173 of mold 172. After cooling, the leg mold portion 192 attached to the modular mold 172 is removed to expose first leg portion 34 extending outside the mold 172 at opening 186*a*. Likewise second leg mold portion 192 is removed to expose a second leg portion 35 extending outside the mold 172 at opening 186*b*. The mold parts 174, 176 are separated from each other to remove bed 10 from the concave interior cavity 173.

Figure 18:
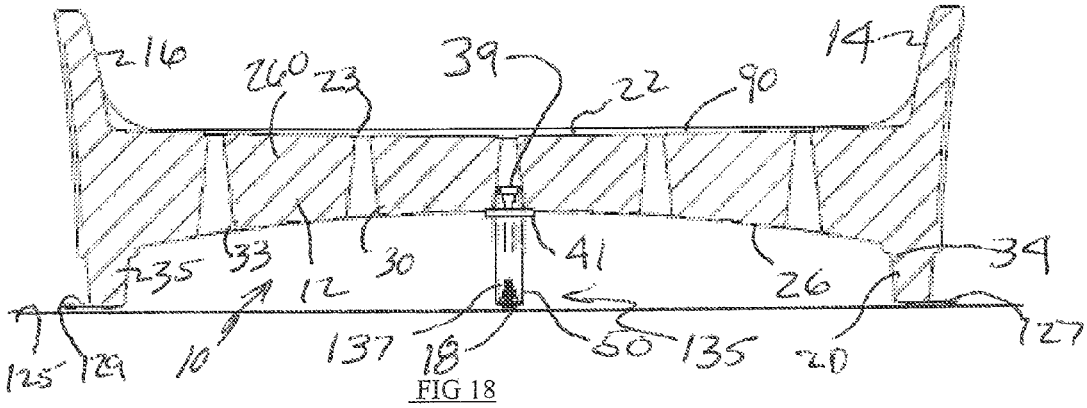
FIG. 18 is a section view of the first embodiment taken at approximately 6-6 of FIG. 2 showing the optional bariatric support leg mounted in a drain exit.

Referring to FIG. 18, an optional bariatric support leg 135 may be mounted in a drain exit 30 on bottom surface 26. Bariatric support leg 135 may extend from bottom surface 26 to floor 125. Bariatric support leg 135 may have top end 39 having a tapered shape adapted to be fastened into one of the drain exits 30, for example proximate the middle of the span between the head board 14 and the foot board 16 by adhesive or threaded means to prevent removal and tampering. Bariatric support leg 135 has a floor end 137 that may be adapted with a glide pocket 50 for receiving a tamper resistant glide 18 as described herein. A drain may be formed in bariatric support leg 135 to allow liquids in drain body 38 to flow through bariatric support leg 135 to an air space adjacent bottom surface 26.

Figure 19:
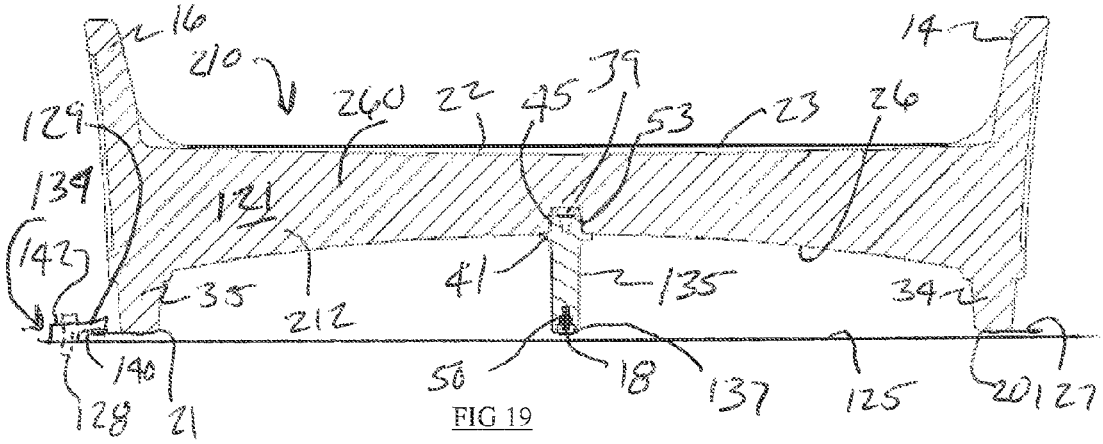
FIG. 19 is a section view of a third embodiment without drains taken at a similar view as 6-6 of FIG. 2 showing the optional bariatric support leg mounted in the bottom surface.

Referring to FIG. 19, a third embodiment of the modular support bed 210 may be formed with a solid body 121. The optional bariatric support leg 135 may be mounted in bottom surface 26 by forming a hole 45 therein. Bariatric support leg 135 may extend from bottom surface 26 to floor 125. Top end 39 may be adapted to be inserted into hole 45 and fixed thereto by adhesive or welding or the like. Alternatively, top end 39 may be fastened directly to bottom surface 26 by adhesive or the like. Flange anchor 134 may be attached to floor 125 to provide a slide in pocket 140 adapted to receive one of the mounting flanges 127, 129. Body 212 may comprise a hollow cavity which may be filled with structural foam 260. Structural foam 260 may be polyurethane foam selected for increased durability and sound absorption. The filler 260 may be injected under pressure and may consist of urethane foam or other material that can conform to the irregular cavities created during the molding process.

In use, the intensive use bed 10, 110 is formed by attaching a modular feature mold portion 191 to each of the foot openings 186*a* and 186*b* to the rotary mold 170. The first half 174 and the second-half 176 are attached together. A plurality of drain bodies 38 may be positioned inside the hollow shell 172 and extending between the first half 174 in the second half 176 prior to attaching to form the rotary mold 170. The bed 10, 110 is formed by a traditional rotary mold techniques inserting a liquid plastic material into the closed rotary mold 170. The rotary mold 170 is then rotated and heated to form a hollow bed body 12.

The bed 10, 110 may have mounting flanges 127, 129 attached to the feet 20, 21. One or more tamper resistant glides 18 may be attached to one or more of the feet 20, 21 depending on the configuration of floor 125. Likewise, bariatric support leg 135 may be attached to bottom surface 26 intermediate feet 20, 21. Bariatric support leg 135 may similarly have a tamper resistant glide 18 attached thereto and adapted to extend the pad from the pad opening to engage floor 125. Flange anchor 134 may be attached to floor 125 by threaded fasteners or the like to slidably receive tongue portion 132 of one of the mounting flanges 127, 129. The bed 10, 110 is brought into a desired position may be positioned in a level orientation by use of the tamper resistant glides 18. The bed 10, 110 may be positioned unattached on floor 125 or maybe attached to floor 125 by use of the mounting flanges 127, 129, or other means such as directly bolting to floor 125.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

We claim:

1. An intensive use bed having a substantially rectangular, hollow bed body comprising a top wall spaced from a bottom wall, a headboard on the top wall and bottom wall, a foot board spaced from the headboard, the foot board on the top wall and bottom wall, and two sides, the two sides in spaced relation to each other, each of the two sides connected to the headboard and the foot board, the headboard and the foot board in spaced relation to each other, a first foot on the headboard, a second foot on the foot board, the bed further comprising:

a sleeping surface on the top wall;

a first drain having a hollow first drain body, the hollow first drain body having a first bottom drain end on the bottom wall and a first top drain end on the top wall, material removed from the top wall adjacent the first top drain end to form a first drain entrance in fluid communication with the hollow drain body, material removed from the bottom wall adjacent the first bottom drain end to form a first drain exit in fluid communication with the hollow drain body; and a channel formed in the sleeping surface, the channel in fluid communication with the first drain entrance, whereby the channel and the first drain form a fluid path through the bed body.

2. The invention of claim 1, wherein the fluid path further comprises a second drain in the bed body, the second drain having a hollow second drain body having a second top end on the top wall and a second bottom end on the bottom wall, the top wall having material removed adjacent to the second top end to form a second drain entrance in fluid communication with the hollow second drain body and the bottom wall having material removed adjacent the second bottom end to form a second drain exit in the bottom wall in fluid communication with the hollow drain body, the second drain entrance in fluid communication with the channel.

3. The invention of claim 1, wherein the sleeping surface further comprises a contoured surface, the fluid path further comprising a plurality of channels in fluid communication with the first drain.

4. The invention of claim 1, further comprising a first mounting flange on the bed.

5. The invention of claim 1, further comprising a bariatric support in the first drain exit.

6. The invention of claim 4, further comprising a flange anchor, the flange anchor having a pocket for removably receiving the first mounting flange, the first mounting flange removably in the pocket.

7. The invention of claim 1, further comprising a tamper resistant, adjustable glide assembly, the glide assembly comprising a first lock washer, a glide pad, and a support shaft, the support shaft having a first end on the glide pad and a second end attached to the first lock washer, a glide pocket formed in the first foot, the glide pocket having a pad opening and a pad chamber, the pad chamber having a sidewall, a support shoulder, and an adjustment chamber, the glide assembly in the glide pocket.

8. The invention of claim 7, wherein the first lock washer further comprises a plurality of exterior edges adapted to engage the pad chamber sidewall.

9. The invention of claim 8, wherein the glide assembly further comprises a traveler attached to the first lock washer, the traveler threadably on the support shaft, a shoulder plate on the traveler adapted to engage the pad chamber sidewall.

10. The invention of claim 1, wherein the bed further comprises a liquid barrier surrounding the sleeping surface.

11. The invention of claim 1, further comprising a plurality of hollow supports in the bed body, each of the supports extending from the top wall to the bottom wall to hold the bottom wall in spaced relation to the top wall.

12. The invention of claim 11, where in the first drain body is integral with one of the plurality of hollow supports.

13. The invention of claim 1 further comprising a modular mold surrounding the bed, the modular mold having a hollow cavity surrounding the bed body, a first foot opening adjacent to the headboard, and a second foot opening adjacent to the foot board, the first foot opening surrounded by a head flange, the second foot opening surrounded by a foot flange, a first modular feature mold portion on the head flange, a second modular feature mold portion on the foot flange.

14. The invention of claim 13, wherein the modular feature mold portion is selected from a configuration selected from: a foot mold portion adapted to mold a foot on the bed body and a leg mold portion adapted to mold a leg on the bed body, the leg having a foot spaced from the bed body.

15. The invention of claim 6 further comprising a glide pocket on the first foot, the glide pocket having sidewalls and a pad opening, a tamper resistant glide in the glide pocket, the tamper resistant glide having a support shaft, a glide foot and a lock washer, the support shaft having a first end on the glide foot, a second end in the glide pocket, the lock washer threadably attached to the support shaft adjacent the second end, the lock washer having a plurality of tips adapted to engage the glide pocket sidewalls.

16. An intensive use bed comprising:

a substantially rectangular hollow bed body having a top wall, a bottom wall, two spaced sidewalls, a headboard and a foot board, the foot board spaced from the headboard, the top wall connected to the two side walls, headboard and foot board, a contoured sleeping surface on the top wall, the bottom wall connected to the two side walls, headboard and foot board in spaced relation to the top wall;

a plurality of drains in the bed body, the drains forming a fluid path through the bed body, each drain comprising a hollow drain body, each drain body having a an open top attached to the top wall and an open bottom attached to the bottom wall;

a first foot on the headboard and a second foot on the foot board;

a first mounting flange on the first foot, the first mounting flange having a tongue portion extending from the first foot; and a flange anchor, the flange anchor having a pocket adapted to receive the tongue portion, the tongue portion in the pocket of the flange anchor.

17. The invention of claim 16, further comprising a liquid barrier surrounding the sleeping surface, a channel on the sleeping surface, a separate drain entrance formed in the sleeping surface in fluid communication with each hollow drain body, the channel extending from one drain entrance to a predetermined position proximate the liquid barrier, each drain entrance in fluid communication with the channel, material removed from the bottom wall to form a drain exit in fluid communication with the bottom of each drain body, the sleeping surface further comprising a sloping contour adapted to urge a liquid to flow toward the drain by a gravitational force.

18. The invention of claimed 17, further comprising a glide pocket in the first foot and second foot, each glide pocket having an surrounding sidewall, an adjustment chamber, a support shoulder, and a pad opening, a tamper resistant glide mounted in one glide pocket, the tamper resistant glide comprising a pad, a support shaft, means for fixing the glide in the glide pocket and a means for adjusting the position of the pad with respect to the support shoulder, the pad adjustably in the pad opening.

19. The invention of claim 16, further comprising a modular, rotational molding mold surrounding the bed, the modular mold having an interior cavity surrounding the body, headboard and foot board, the modular mold further comprising a first foot opening surrounding the first foot, and a second foot opening surrounding the second foot, a plurality of modular feature mold portions each modular feature mold portion adapted to attach to either the first foot opening or the second foot opening, the modular feature mold portion having a interior concave configuration in fluid communication with the interior cavity, the interior concave configuration selected from the group consisting of: a mold feature cavity adapted for forming a foot portion on the bed body or, a mold feature cavity adapted for forming a leg portion on the bed body, a foot portion on the leg portion, the foot portion spaced from the bed body by the leg portion.

20. An intensive use bed comprising:

a substantially rectangular body having a sleeping surface, a bottom wall, a head board and a foot board, the sleeping surface spaced from the bottom wall, a liquid barrier on the body the liquid barrier surrounding the sleeping surface;

a plurality of drains extending through the body, each drain having a drain body, each drain body having a bottom drain end on the bottom wall and a top drain end on the top wall, material removed from the bottom wall adjacent the bottom drain end of one of the plurality of drains to form a drain exit, material removed from the sleeping surface adjacent to the top drain end of the one of the plurality of drains to form a drain entrance;

a channel formed in the sleeping surface, the channel extending from the drain entrance to a position intermediate the drain entrance and the liquid barrier;

a first foot on the headboard, the first foot having a first mounting flange thereon;

a glide pocket formed in the first foot, the glide pocket having a pad opening, an adjustment chamber and a sidewall, a shoulder support in the sidewall; and a tamper resistant glide in the glide pocket, the tamper resistant glide having a traveler, a pad and a support shaft, the pad in the pad opening, the support shaft having a first end on the pad, a second end in the adjustment chamber, a locking washer and a shoulder plate on the traveler, the locking washer comprising a plurality of generally circular concave washers, each concave washer having a peripheral edge with sidewall engaging tips adapted to engage the sidewall, the locking washer on the traveler, the support shaft threadably engaging the traveler, the sidewall engaging tips attached to the sidewall, the shoulder plate bearing against the shoulder support, whereby rotation of the support shaft urges the pad to traverse in the pad chamber.

* * * * *